US009418598B2

(12) United States Patent
Hinton

(10) Patent No.: US 9,418,598 B2
(45) Date of Patent: Aug. 16, 2016

(54) COLOUR DISPLAY

(75) Inventor: Jeremy Lynn Hinton, Bishopston (GB)

(73) Assignee: BAE SYSTEMS plc, London (GB)

( * ) Notice: Subject to any disclaimer, the term of this patent is extended or adjusted under 35 U.S.C. 154(b) by 224 days.

(21) Appl. No.: 13/498,730

(22) PCT Filed: Sep. 17, 2010

(86) PCT No.: PCT/GB2010/051565
§ 371 (c)(1),
(2), (4) Date: Mar. 28, 2012

(87) PCT Pub. No.: WO2011/039525
PCT Pub. Date: Apr. 7, 2011

(65) Prior Publication Data

US 2012/0182331 A1 Jul. 19, 2012

(30) Foreign Application Priority Data

Sep. 29, 2009 (EP) ..... 09275086
Sep. 29, 2009 (GB) ..... 0917045.7

(51) Int. Cl.
*G09G 5/10* (2006.01)
*G09G 3/34* (2006.01)

(52) U.S. Cl.
CPC ..... *G09G 3/3413* (2013.01); *G09G 2310/0235* (2013.01); *G09G 2320/0242* (2013.01); *G09G 2320/0261* (2013.01)

(58) Field of Classification Search
None
See application file for complete search history.

(56) References Cited

U.S. PATENT DOCUMENTS 5,406,299 A 4/1995 Post
5,534,949 A 7/1996 Baron
5,684,498 A 11/1997 Welch et al.
7,403,179 B2 * 7/2008 Koyama et al. ..... 345/76
8,836,624 B2 * 9/2014 Roberts ..... G09G 3/3413 345/102
2002/0075224 A1 * 6/2002 Son ..... G09G 3/3413 345/102
2005/0094056 A1 * 5/2005 Hong ..... G09G 3/2011 349/61
2006/0007105 A1 * 1/2006 Chen ..... G09G 3/3413 345/102
2008/0198112 A1 * 8/2008 Roberts ..... G09G 3/3413 345/88
2009/0115719 A1 5/2009 Lin et al.

(Continued)

FOREIGN PATENT DOCUMENTS

EP 0676740 A1 10/1995
EP 2128849 A1 12/2009

(Continued)

OTHER PUBLICATIONS

International Search Report (PCT/ISA/210) issued on Nov. 2, 2010, by European Patent Office as the International Searching Authority for International Application No. PCT/GB2010/051565.

(Continued)

*Primary Examiner* — Srilakshmi K Kumar
*Assistant Examiner* — Parul Gupta
(74) *Attorney, Agent, or Firm* — Finch & Maloney PLLC

(57) ABSTRACT

A color sequential display method and apparatus that reduces or eliminates color breakup. In a given frame an illumination source provides a first illumination color in a first subframe, a second illumination color in a third subframe, and both the first and second illumination colors simultaneously in a second subframe to provide a third mixed illumination color. A pixel is driven either: (a) during the first subframe to display the first color; or (b) during the third subframe to display the second color; or (c) at least during the second subframe to display the third color.

14 Claims, 5 Drawing Sheets

(56) References Cited

U.S. PATENT DOCUMENTS

| | | | | |
|---|---|---|---|---|
| 2009/0278778 | A1 | 11/2009 | Tanaka | |
| 2009/0322797 | A1 | 12/2009 | Tokui | |
| 2010/0079366 | A1* | 4/2010 | Lin | G09G 3/3413 345/102 |
| 2013/0293598 | A1* | 11/2013 | Ishihara | G09G 3/3648 345/690 |

FOREIGN PATENT DOCUMENTS

| | | | |
|---|---|---|---|
| WO | WO 02/11113 | A2 | 2/2002 |
| WO | WO 2004/032523 | A1 | 4/2004 |
| WO | WO 2008/015953 | A1 | 2/2008 |
| WO | WO 2009/075165 | A1 | 6/2009 |

OTHER PUBLICATIONS

European Search Report dated Mar. 22, 2010 for European Application No. 09275086.8.

Great Britain Search Report dated Dec. 15, 2009 for Great Britain Application No. 0917045.7.

H. Yamakita et al., Field-Sequential Color LCD driven by Optimized Method for Color Breakup Reduction, London UK, Jan. 1, 2005, pp. 83-86.

Notification Concerning Transmittal of International Preliminary Report on Patentability (Forms PCT/IB/326 and PCT/IB/373) and the Written Opinion of the International Searching Authority (Form PCT/ISA/237) issued on Apr. 12, 2012, in the corresponding International Application No. PCT/GB2010/051565. (13 pages).

* cited by examiner

COLOUR DISPLAY

FIELD OF THE INVENTION

The present invention relates to colour sequential display devices or systems, and drivers therefor, and to driving or addressing methods for such display devices or systems.

BACKGROUND

Colour sequential display devices exploit the eye's response time by presenting different primary colours in rapid succession at a given pixel to give the perception of a single display colour represented by the different primaries for the given pixel. This is in contrast to e.g. colour display devices with different coloured sub-pixels for each pixel where a perception of a single display colour for the given pixel is provided by simultaneous presentation of the different primaries by the respective sub-pixels of the pixel.

A known problem with colour sequential display devices is that of colour breakup. If the speed of eye movement during the colour sequence is sufficiently high compared to the frame rate at which the different colours in the sequence are being presented then the eye movement causes sufficient separation of the different primary colours on the retina for the viewer to perceive breakup of colour in the image, i.e. the different primary colours separate out in the perceived image. The problem of colour breakup is particularly marked in display applications where rapid eye movement is to be expected, for example in the case of head-up displays.

Various approaches to compensating for or reducing colour breakup have been disclosed. Many involve shifting the colour information to compensate for eye movement, as disclosed for example in U.S. Pat. No. 5,684,498.

SUMMARY OF THE INVENTION

In a first aspect, the present invention provides a colour sequential display method, the method comprising, in a given frame: an illumination source providing illumination to a display panel, wherein the provided illumination, for each of a first subframe, a second subframe and a third subframe of the frame each occupying a separate respective temporal part of the frame but not necessarily in that order, comprises: (i) substantially only a first illumination colour in the first subframe; (ii) substantially only a second illumination colour in the third subframe; and (iii) both the first illumination colour and the second illumination colour provided simultaneously in the second subframe to provide a third illumination colour, the third illumination colour being an illumination colour provided by mixing of the first and second illumination colours; and the method further comprising, in the given frame: driving a given pixel either: (a) during the first subframe to display a first output colour corresponding to the first illumination colour; or (b) during the third subframe to display a second output colour corresponding to the second illumination colour; or (c) at least during the second subframe to display a third output colour corresponding to the third illumination colour.

The step (c) of driving the given pixel at least during the second subframe to display the third output colour corresponding to the third illumination colour may comprise driving the given pixel substantially only during the second subframe to display the third output colour corresponding to the third illumination colour.

The first illumination colour may be green, and the second illumination colour may be red, in which case the third mixed illumination colour would be provided by mixing the green and the red.

The first illumination colour, the second illumination colour, and the third mixed illumination colour may be the only illumination colours provided by the illumination source, and the first, second and third output colours may be the only colours output by the display. Another possibility is that further illumination colours with further corresponding output colours may be provided in further subframes of the frame.

The method may be for only or mainly displaying symbols.

In a further aspect, the present invention provides an illumination driver for driving an illumination source of a colour sequential display device; the illumination driver arranged to, in a given frame in which a first subframe, a second subframe and a third subframe of the frame each occupy a separate respective temporal part of the frame but are not necessarily in that order, drive the illumination source to provide: (i) substantially only a first illumination colour in the first subframe; (ii) substantially only a second illumination colour in the third subframe; and (iii) both the first illumination colour and the second illumination colour provided simultaneously in the second subframe to provide a third illumination colour, the third illumination colour being an illumination colour provided by mixing of the first and second illumination colours.

In a further aspect, the present invention provides a pixel driver for driving pixels of a colour sequential display device; the pixel driver arranged to, in a given frame in which a first subframe, a second subframe and a third subframe of the frame each occupy a separate respective temporal part of the frame but are not necessarily in that order, drive a given pixel either: (a) during the first subframe to display a first output colour that corresponds to a first illumination colour; or (b) during the third subframe to display a second output colour that corresponds to a second illumination colour; or (c) at least during the second subframe to display a third output colour, the third output colour corresponding to a third illumination colour that is a mixture of the first illumination colour of the second illumination colour.

In a further aspect, the present invention provides a display driver for a colour sequential display device, the display driver comprising an illumination driver and a pixel driver; the illumination driver arranged to, in a given frame in which a first subframe, a second subframe and a third subframe of the frame each occupy a separate respective temporal part of the frame but are not necessarily in that order, drive the illumination source to provide: (i) substantially only a first illumination colour in the first subframe; (ii) substantially only a second illumination colour in the third subframe; and (iii) both the first illumination colour and the second illumination colour provided simultaneously in the second subframe to provide a third illumination colour, the third illumination colour being an illumination colour provided by mixing of the first and second illumination colours; the pixel driver arranged to, in the given frame, drive the given pixel either: (a) during the first subframe to display a first output colour corresponding to the first illumination colour; or (b) during the third subframe to display a second output colour corresponding to the second illumination colour; or (c) at least during the second subframe to display a third output colour, the third output colour corresponding to the third illumination colour.

In the above driver aspects of the invention, the choice (c) of driving the given pixel at least during the second subframe to display the third output colour may comprise driving the given pixel substantially only during the second subframe to display the third output colour.

In the above driver aspects of the invention, the first illumination colour may be green, and the second illumination colour may be red, in which case the third mixed illumination colour is provided by mixing the green and the red.

In the above driver aspects of the invention, the first illumination colour, the second illumination colour, and the third mixed illumination colour may be the only illumination colours and the first, second and third output colours may be the only output colours. Another possibility is further illumination colours with further corresponding output colours may be provided in further subframes of the frame.

In the above driver aspects of the invention, the driver may be for driving a display that only or mainly displays symbols.

In a further aspect, the present invention provides a colour sequential display device, comprising: an illumination driver according to any of the above illumination driver aspects; an illumination source; a pixel driver according to any of the above pixel driver aspects; and a display panel; wherein: the illumination source is driven by the illumination driver; the display panel is driven by the pixel driver; and the display panel is illuminated by the illumination source.

In a further aspect, the present invention provides a colour sequential display method and apparatus in which in a given frame an illumination source provides a first illumination colour, e.g. green, in a first subframe, a second illumination colour e.g. red, in a third subframe, and both the first and second illumination colours simultaneously in a second subframe to provide a third mixed illumination colour. Also in the given frame the pixel is driven either: (a) during the first subframe to display the first colour; or (b) during the third subframe to display the second colour; or (c) at least during the second subframe to display the third colour.

Colour breakup of the mixed colour thereby tends to be reduced, or if choice (c) is carried out only during the second subframe, colour breakup tends to be eliminated.

DETAILED DESCRIPTION

Figure 1:
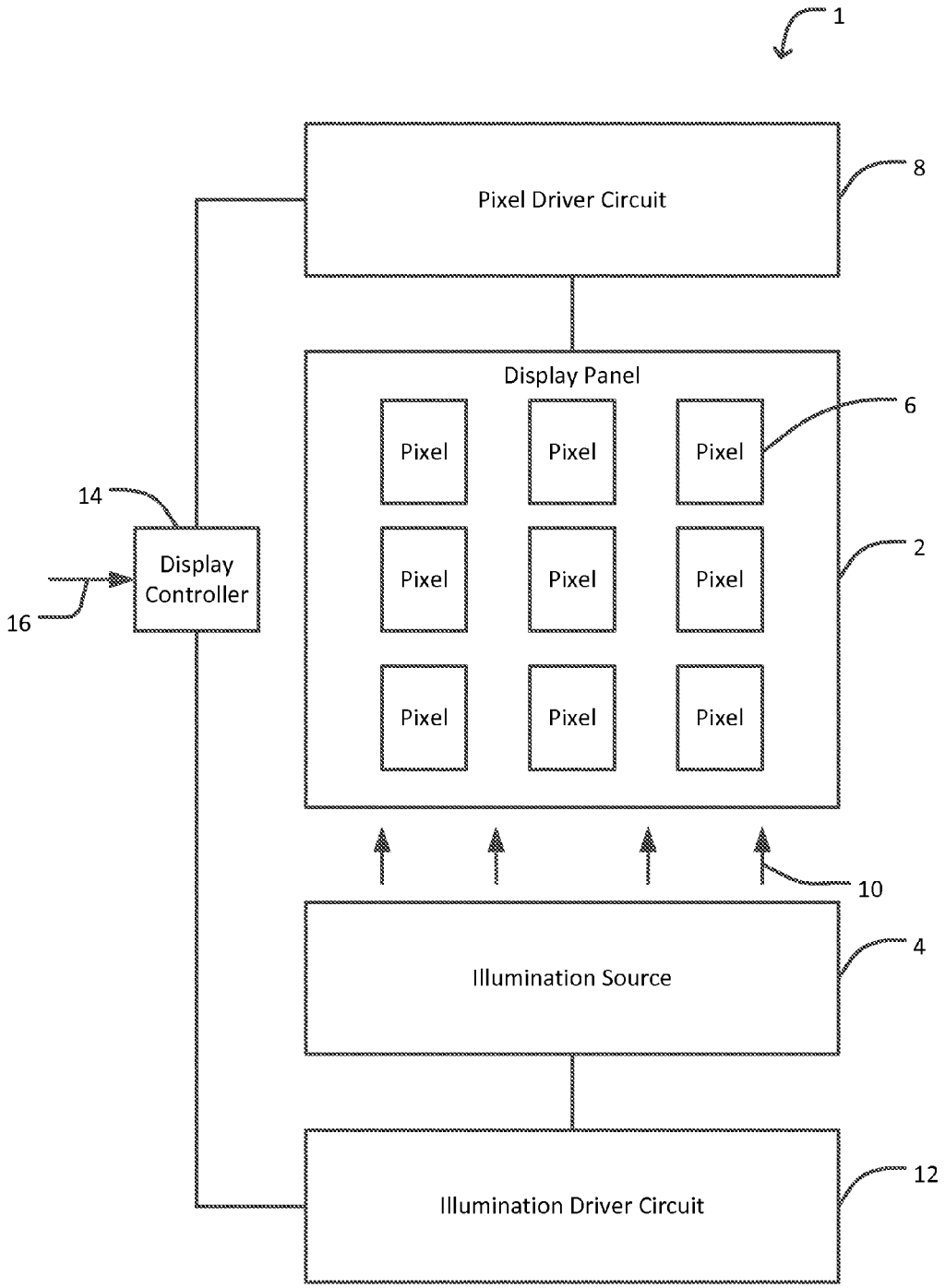
FIG. 1 is a schematic diagram of a colour sequential display device.

FIG. 1 is a schematic diagram of a first embodiment of a colour sequential display device 1. The display device 1 comprises a display panel 2, and an illumination source 4 for illuminating the display panel 2.

In this embodiment the display panel 2 is an active matrix addressed liquid crystal display panel. The display panel 2 has a row and column array of pixels 6. Only a few of the pixels 6 are shown for simplicity. In itself, the display panel 2 is in effect a monochrome display panel. The display device 1 further comprises a pixel driver circuit 8. The pixel driver circuit 8 is connected to the pixels 6.

In this embodiment the illumination source 4 is a projection lamp with a colour wheel. In operation the projection lamp and colour wheel together provide coloured light 10 for illuminating the display panel 2. The display device 1 further comprises an illumination driver circuit 12. The illumination driver circuit 12 is connected to the illumination source 4.

The display device 1 further comprises a display controller 14 that in operation receives display data 16. The display controller 14 is connected to the pixel driver circuit 8 and the illumination driver circuit 12.

The display device 1 is operated as follows. Coloured light 10 from the illumination source 4 enters the display panel 2 and is modulated according to the transmission characteristics of the pixels 6. Each pixel 6 is provided with its respective display setting by an addressing scheme implemented by the pixel driver circuit 8 in which rows of pixels 6 are driven one at a time, and each pixel within that row is provided with its own setting by different display data being applied to each column of pixels. Each addressing of all the rows, with corresponding application of display data to each column during each addressing of a row, constitutes a first colour subframe period during which a first colour of coloured light 10 is provided by the illumination source 4. Then a following addressing of all the rows, with corresponding application of display data to each column during each addressing of a row, constitutes a second colour subframe period during which a second colour of coloured light 10 is provided. Then a following addressing of all the rows, with corresponding application of display data to each column during each addressing of a row, constitutes a third colour subframe period during which a third colour of coloured light 10 is provided. The first, second and third sequentially applied colour subframe periods together provide a full frame period. The provision by the illumination source of the different colours of the coloured light 10 during the respective colour subframe periods is implemented by colour drive signals from the illumination driver circuit 12.

The display data 16 is provided to the display controller 14 from an external source. The display data 16 is typically provided on a frame-by-frame basis. The display controller 14 controls the operation of the pixel driver circuit 8 and the illumination driver circuit 12, including for example providing timing pulses, and forwards the display data to the pixel driver circuit 8.

Other details of the display device 1, except where otherwise stated below in relation to the provision of novel colour arrangements, are implemented in conventional fashion, which is well known to the skilled person in the field of colour sequential display devices.

As will be described in more detail with reference to FIG. 2, in this embodiment, the provision of novel colour arrangements comprises the illumination source being provided such as to provide two basic illumination colours, namely green and red, and these colours being provided temporally such as to provide three discrete display output colours, namely green, red and yellow, and a novel driving scheme for the display panel 2 and the illumination source 4 is also provided.

Figure 2:
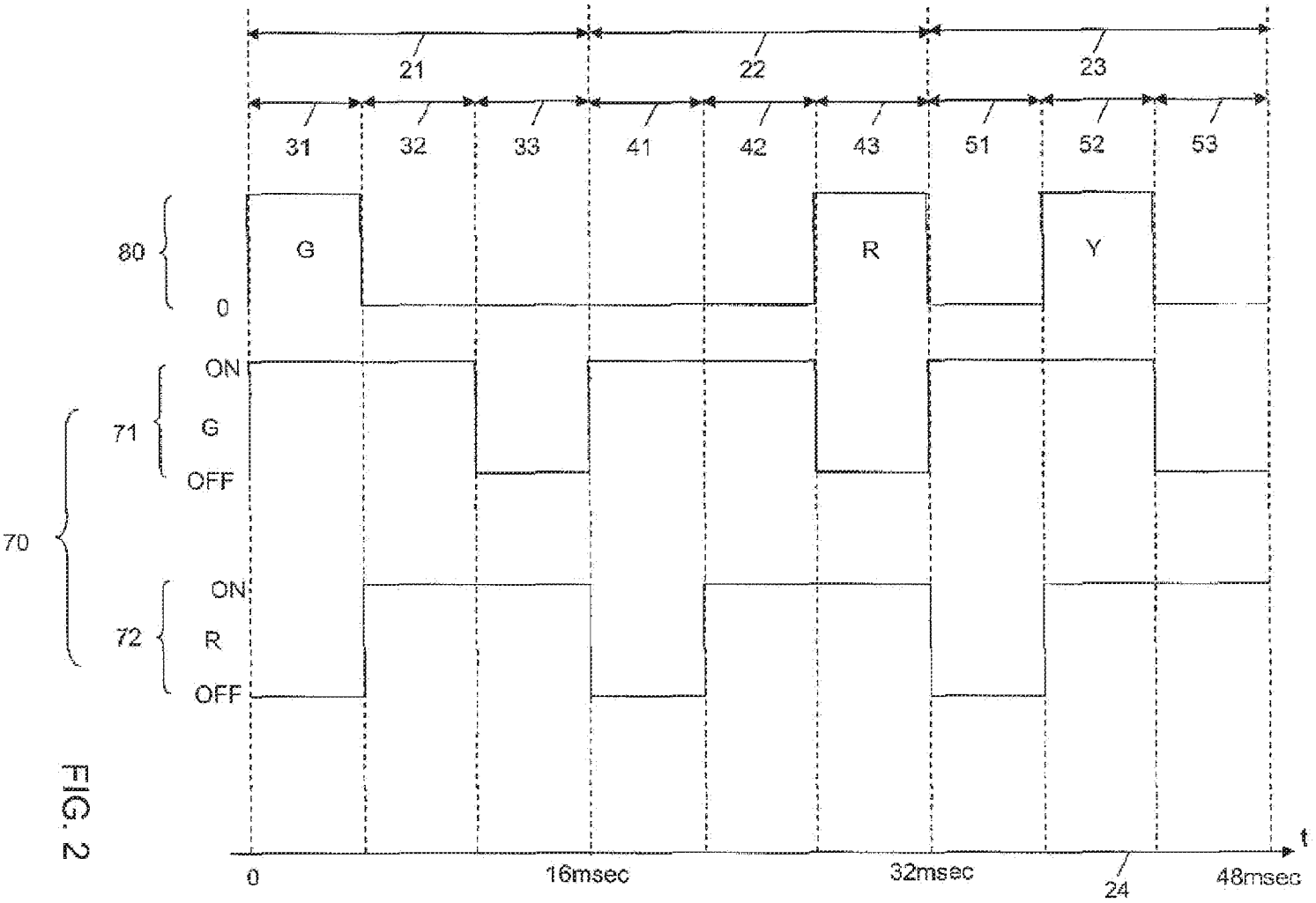
FIG. 2 is a schematic illustration of an embodiment of a driving scheme.

FIG. 2 is a schematic illustration of the driving scheme, of this embodiment, for the display panel 2 and illumination source 4. Three representative frames, namely a first frame 21, a second frame 22 and a third frame 23, are shown for a single pixel 6, by way of example, against a time axis indicated by reference numeral 24. In this embodiment each frame is of 16 msec duration. Each frame 21, 22, 23 is further shown divided into its first, second and third colour subframe. Each colour subframe is of equal duration. More particularly, the first frame 21 is divided into its first colour subframe 31, its second colour subframe 32 and its third colour subframe 33; the second frame 22 is divided into its first colour subframe 41, its second colour subframe 42 and its third colour subframe 33; and the third frame 23 is divided into its first colour subframe 51, its second colour subframe 52 and its third colour subframe 53.

In this driving scheme, driving operation is applied to the illumination source 4 under control of the illumination driver circuit 12. This driving operation provides separate temporal control of the two basic illumination colours, namely green and red, of the illumination source 4. In overview, the driving operation drives the two basic illumination colours of the illumination source 4 differently (on a temporal basis) within each frame, i.e. the green illumination is driven differently to the red illumination, however, this driving operation is repeated in the same form for each frame, i.e. from one frame to the next.

FIG. 2 shows a schematic plot (indicated by reference numeral 70) of the driving operation applied to the illumination source 4 in this embodiment. The driving operation 70 comprises separate respective plots for the two basic illumination colours of the illumination source 4, namely a schematic plot (indicated by reference numeral 71) of the driving of the green illumination of the illumination source 4 and a schematic plot (indicated by reference numeral 72) of the driving of the red illumination of the illumination source 4. The green illumination 71 is provided, i.e. is "ON", during the duration of the first and second colour subframe of each frame, and is not provided, i.e. is "OFF", during the duration of the third colour subframe of each frame e.g. in the case of the first frame 21, the green illumination 71 is provided, i.e. is "ON" during the duration of the first colour subframe 31 and the second colour subframe 32, and is not provided, i.e. is "OFF", during the duration of the third colour subframe 33. The red illumination 72 is provided differently to the green illumination 71. In more detail, the red illumination 72 is provided, i.e. is "ON", during the duration of the second and third colour subframe of each frame, and is not provided, i.e. is "OFF", during the duration of the first colour subframe of each frame e.g. in the case of the first frame 21, the red illumination 72 is provided, i.e. is "ON" during the duration of the second colour subframe 32 and the third colour subframe 33, and is not provided, i.e. is "OFF", during the duration of the first colour subframe 31. Overall, therefore, the driving operation 70 provides only green illumination in the first colour subframe of each frame, both green and red illumination simultaneously in the second colour subframe of each frame, and only red illumination in the third colour subframe of each framed. The simultaneous provision of both green and red illumination in the second colour subframe of each frame provides therefore in effect yellow illumination. Thus for each frame, the first, second and third colour subframes respectively provide three colours of illumination, namely green, yellow and red, which correspondingly provide the three above mentioned discrete display output colours.

Also in this driving scheme, in a given frame, display data for only one of the discrete display output colours, namely green, red and yellow, is provided. Depending on which discrete output colour is to be displayed by the pixel in the given frame, the relevant display data value is provided in the appropriate colour subframe. FIG. 2 further shows an example schematic plot (indicated by reference numeral 80) of display data provision. In this embodiment, if the pixel 6 is to display green output in a given frame, then the relevant display data value is applied during the first colour subframe of the relevant frame. In FIG. 2 this is shown by way of example for the first frame 21, hence the first colour subframe 31 of the first frame 21 has a non-zero display data value, whereas the display data values for the second colour subframe 32 and the third colour subframe 33 are both zero. Correspondingly, if the pixel 6 is to display red output in a given frame, then the relevant display data value is applied during the third colour subframe of the relevant frame. In FIG. 2 this is shown by way of example for the second frame 22, hence the third colour subframe 43 of the second frame 22 has a non-zero display data value, whereas the display data values for the first colour subframe 41 and the second colour subframe 42 are both zero. Correspondingly, if the pixel 6 is to display yellow output in a given frame, then the relevant display data value is applied during the second colour subframe of the relevant frame. In FIG. 2 this is shown by way of example for the third frame 23, hence the second colour subframe 52 of the third frame 23 has a non-zero display data value, whereas the display data values for the first colour subframe 51 and the third colour subframe 53 are both zero.

Thus in operation, the display device 1 can display three separate output colours from only a two-coloured illumination source. The three separate output colours are separately displayable from a single pixel using the colour sequential process. However, the third or extra colour (in this embodiment yellow) is produced from simultaneous mixing of the two basic illumination source colours in a dedicated additional colour subframe that is provided for this purpose. Thus there is no colour breakup of the yellow display output colour. Thus, advantageously a colour sequential display device is provided (with its attendant advantages e.g. no need for colour sub-pixels), in which three output colours are provided despite having only two basic illumination colours (with attendant advantages e.g. cost and space saving), and yet no colour breakup occurs in the "mixed" colour.

The surprising advantages of the above described device may further be appreciated by considering a hypothetical comparison device which represents the device that would result were a conventional colour sequential display device with three basic illumination colours (green, red, blue) that are time sequentially mixed to provide extra colours to be simplified to a device with only two basic illumination colours (e.g. green and red) arranged to provide three separate output colours of green, red and yellow (=mixture of green and red), but with the simplified device maintaining use of the conventional colour sequence process for colour mixing. In such a hypothetical case, the resulting device would have a driving scheme as shown in FIG. 3.

Three representative frames, namely a first frame 121, a second frame 122 and a third frame 123, are shown for a single pixel, by way of example, against a time axis indicated by reference numeral 124. Each frame is divided into a first (131, 141, 151) and a second (132, 142, 152) colour subframe.

Figure 3:
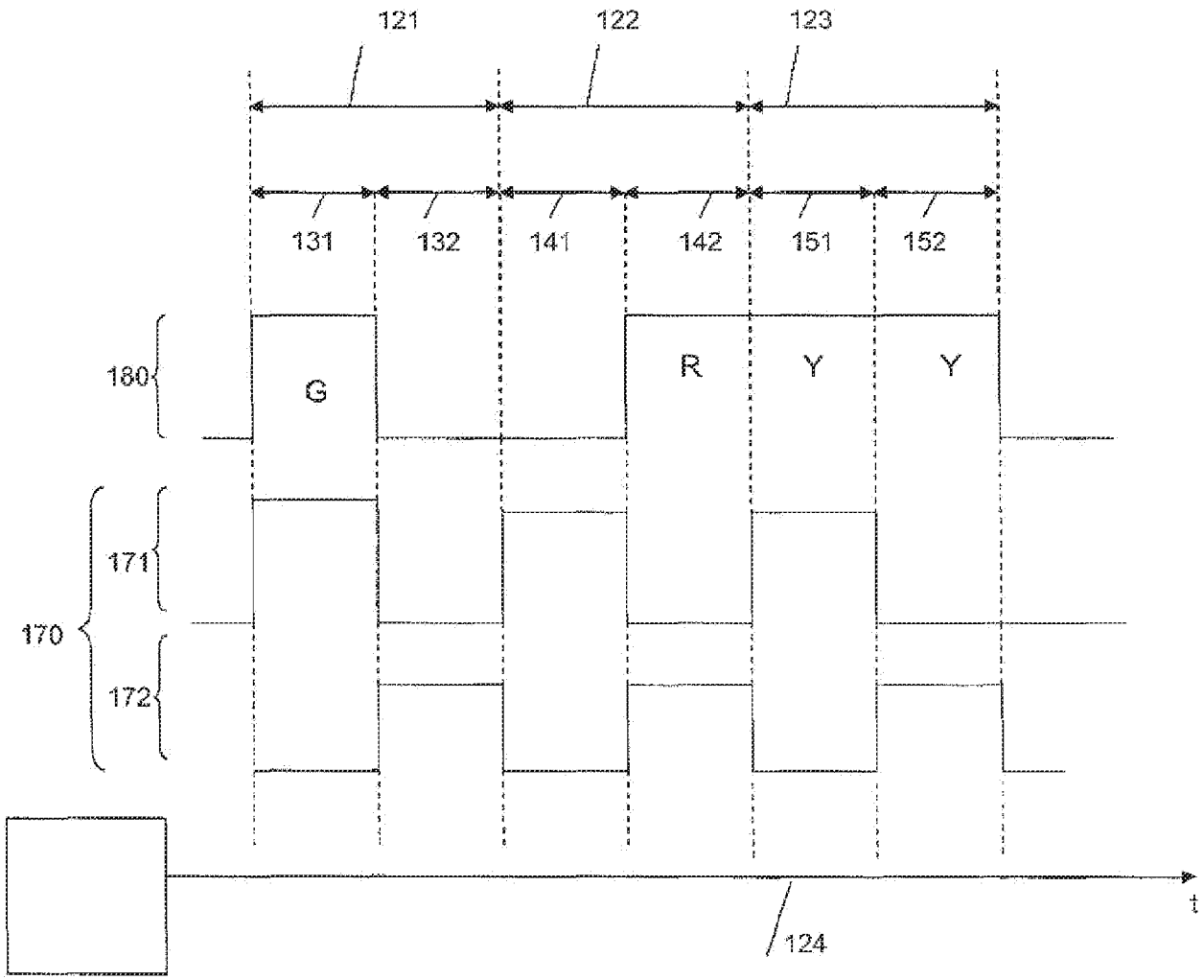
FIG. 3 is a hypothetical driving scheme of a hypothetical comparison device.

FIG. 3 shows a schematic plot (indicated by reference numeral 170) of the driving operation that would be applied to an illumination source in this hypothetical comparison device. The driving operation 170 comprises separate respective plots for the two basic illumination colours of the illumination source, namely a schematic plot (indicated by reference numeral 171) of the driving of the green illumination of the illumination source 4 and a schematic plot (indicated by reference numeral 172) of the driving of the red illumination of the illumination source. The green illumination 71 is provided, i.e. is "ON", during the duration of the first colour subframe of each frame, and is not provided, i.e. is "OFF", during the duration of the second colour subframe of each frame e.g. in the case of the first frame 121, the green illumination 171 is provided, i.e. is "ON" during the duration of the first colour subframe 131, and is not provided, i.e. is "OFF", during the duration of the second colour subframe 132. The red illumination 172 is not provided, i.e. is "OFF", during the duration of the first colour subframe of each frame, and is provided i.e. is "ON", during the duration of the second colour subframe of each frame e.g. in the case of the first frame 121, the red illumination 172 is not provided, i.e. is "OFF", during the duration of the first colour subframe 131 and is provided, i.e. is "ON" during the duration of the second colour subframe 132. Overall, therefore, the driving operation 70 provides only green illumination in the first colour subframe of each frame, and only red illumination in the second colour subframe of each framed. There is no simultaneous provision of both green and red illumination in a separate dedicated additional colour subframe, rather, in order to produce yellow, the red and green would be mixed using the time sequence approach as is explained in more detail in the next paragraph.

Depending on which output colour were to be displayed by the pixel in the given frame, the relevant display data value would be provided in the appropriate colour subframe. FIG. 3 shows an example schematic plot (indicated by reference numeral 180) of display data provision. If the pixel were to display green output in a given frame, then the relevant display data value would be applied during the first colour subframe of the relevant frame. In FIG. 3 this is shown by way of example for the first frame 21, hence the first colour subframe 131 of the first frame 121 has a non-zero display data value, whereas the display data value for the second colour subframe 132 is zero. If the pixel 6 were to display red output in a given frame, then the relevant display data value would be applied during the second colour subframe of the relevant frame. In FIG. 3 this is shown by way of example for the second frame 122, hence the second colour subframe 142 of the second frame 122 has a non-zero display data value, whereas the display data value for the first colour subframe 141 is zero. If the pixel were to display yellow output in a given frame, then the relevant display data value is applied during both the first and second colour subframe of the relevant frame. In FIG. 3 this is shown by way of example for the third frame 123, hence both the first colour subframe 151 and the second colour subframe 152 of the third frame 123 have non-zero display data values so that first the green illumination will be provided then the red illumination, these being perceived as yellow by the viewer under the time sequential mixing approach. Hence such yellow display would suffer from colour breakup.

Returning now to discussion of the display device 1 embodiment as shown in FIGS. 1 and 2, one application where this device is particularly advantageous is where the display is used for displaying symbols, particularly where the display is used for displaying mainly, or entirely, symbols. In such an application, the presence of just three colours may be sufficient, yet by providing the above described device, high light and power efficiency can be achieved in a device that does not suffer from colour breakup. For example, only two illumination colour sources are required to produce three display colours none of which suffer from colour breakup. Also, by avoiding the use the use of blue illumination, the disadvantages of the low light/high power requirement for blue is avoided.

In the above embodiment, there are two illumination colour sources and these produce three display colours, none of which suffer from colour breakup. However, in other embodiments, more than two colour sources may be provided, resulting in more than three display colours, none of which suffer from colour breakup. One such embodiment will now be described with reference to FIG. 4.

In this further embodiment, the display device 1 is as shown in FIG. 1 and as described with reference thereto above, except that in this further embodiment the illumination source provides three separate basic illumination colours, namely green, red and blue, and consequently the display device provides seven separate output colours, namely green, red, blue, cyan, yellow, magenta, and white.

Figure 4:
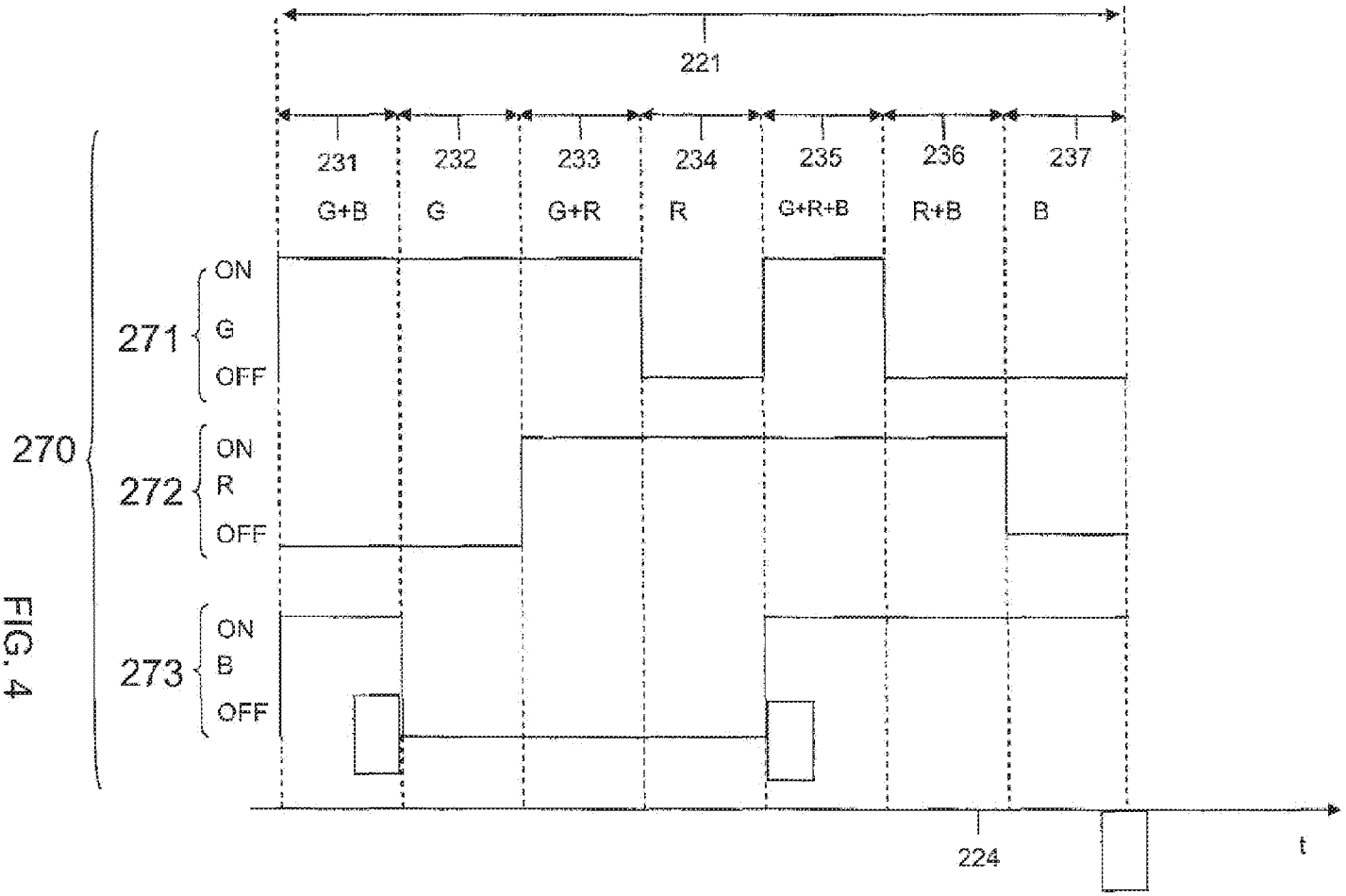
FIG. 4 is a schematic illustration of a further embodiment of a driving scheme.

FIG. 4 is a schematic illustration of the driving scheme of this further embodiment. A single representative frame 221 is shown for a single pixel 6, by way of example, against a time axis indicated by reference numeral 224. In this embodiment each frame is of 40 msec duration. Each frame is divided into seven colour subframes. Each colour subframe is of equal duration. In this example, the frame 221 is divided into its first colour subframe 231, its second colour subframe 232, its third colour subframe 233; its fourth colour subframe 234, its fifth colour subframe 235, its sixth colour subframe 236 and its seventh colour subframe 237.

In particular, FIG. 4 shows a schematic plot (indicated by reference numeral 270) of the driving operation applied to the illumination source 4 in this further embodiment. The driving operation 270 comprises separate respective plots for the three basic illumination colours of the illumination source 4, namely a schematic plot (indicated by reference numeral 271) of the driving of the green illumination of the illumination source 4, a schematic plot (indicated by reference numeral 272) of the driving of the red illumination of the illumination source 4, and a schematic plot (indicated by reference numeral 273) of the driving of the blued illumination of the illumination source 4. The green illumination 271 is provided, i.e. is "ON", during the duration of the first, second, third and fifth second colour subframes of each frame, and is not provided, i.e. is "OFF", during the duration of the other colour subframes of the frame, i.e. the fourth, sixth and seventh colour subframes of each frame. The red illumination 272 is provided differently to the green illumination 71. In more detail, the red illumination 272 is provided, i.e. is "ON", during the duration of the third, fourth, fifth and sixth colour subframes of each frame, and is not provided, i.e. is "OFF", during the duration of the other colour subframes of the frame, i.e. the first, second and seventh colour subframes of each frame. The blue illumination 273 is provided, i.e. is "ON", during the duration of the first, fifth, sixth and seventh colour subframes of each frame, and is not provided, i.e. is "OFF", during the duration of the other colour subframes of the frame, i.e. the second, third and fourth colour subframes of each frame.

Overall, therefore, the driving operation 270 provides green and blue illumination simultaneously in the first colour subframe of each frame, only green illumination in the second colour subframe of each frame, green and red illumination simultaneously in the third colour subframe of each framed, only red illumination in the fourth colour subframe, green and red and blue illumination simultaneously in the fifth colour subframe, red and blue illumination simultaneously in the sixth colour subframe, and only blue illumination in the seventh colour subframe. The simultaneous provision of both green and blue illumination in the first colour subframe of each frame provides in effect cyan illumination in that subframe. The simultaneous provision of both green and red illumination in the third colour subframe of each frame provides in effect yellow illumination in that subframe. The simultaneous provision of both green and red and blue illumination in the fifth colour subframe of each frame provides in effect white illumination in that subframe. The simultaneous provision of both red and blue illumination in the sixth colour subframe of each frame provides in effect magenta illumination in that subframe. Thus for each frame, the first, second, third, fourth, fifth, sixth and seventh colour subframes respectively provide seven colours of illumination, namely cyan (=green+blue), green, yellow (=green+red), red, white (=green+red+blue), magenta (=red+blue), and blue, which correspondingly provide the above mentioned seven discrete display output colours.

As in the case of the driving scheme described earlier above with reference to FIG. 2, in a given frame, display data for only one of the discrete display output colours, (here cyan, green, yellow, red, white, magenta, and blue) is provided. Depending on which discrete output colour is to be displayed by the pixel in the given frame, the relevant display data value is provided in the appropriate colour subframe, i.e. data for cyan is provided in the first colour subframe, data for green is provided in the second colour subframe, data for yellow is provided in the third colour subframe, data for red is provided in the fourth colour subframe, data for white is provided in the fifth colour subframe, data for magenta is provided in the sixth colour subframe, or data for blue is provided in the seventh colour subframe.

Thus in operation, the display device 1 of this further embodiment can display seven separate output colours from only a three-coloured illumination source. The seven separate output colours are separately displayable from a single pixel using the colour sequential process. However, the four output colours that are made by adding two or three of the illumination source colours are produced from simultaneous mixing of the two or three basic illumination source colours in respective dedicated additional colour subframes that are provided for this purpose. Thus there is no colour breakup for these four additive output colours. Thus, advantageously a colour sequential display device is provided (with its attendant advantages e.g. no need for colour sub-pixels), in which seven output colours are provided despite having only three basic illumination colours (with attendant advantages e.g. cost and space saving), and yet no colour breakup occurs in the "mixed" colours. These, and other, advantages, may in particular applications make acceptable a trade-off with reduced speed of operation that would tend to be possible compared to the earlier described two illumination colour embodiment, that may therefore cause a degree of visible flicker. Another possibility is to use higher data rates.

Figure 5:
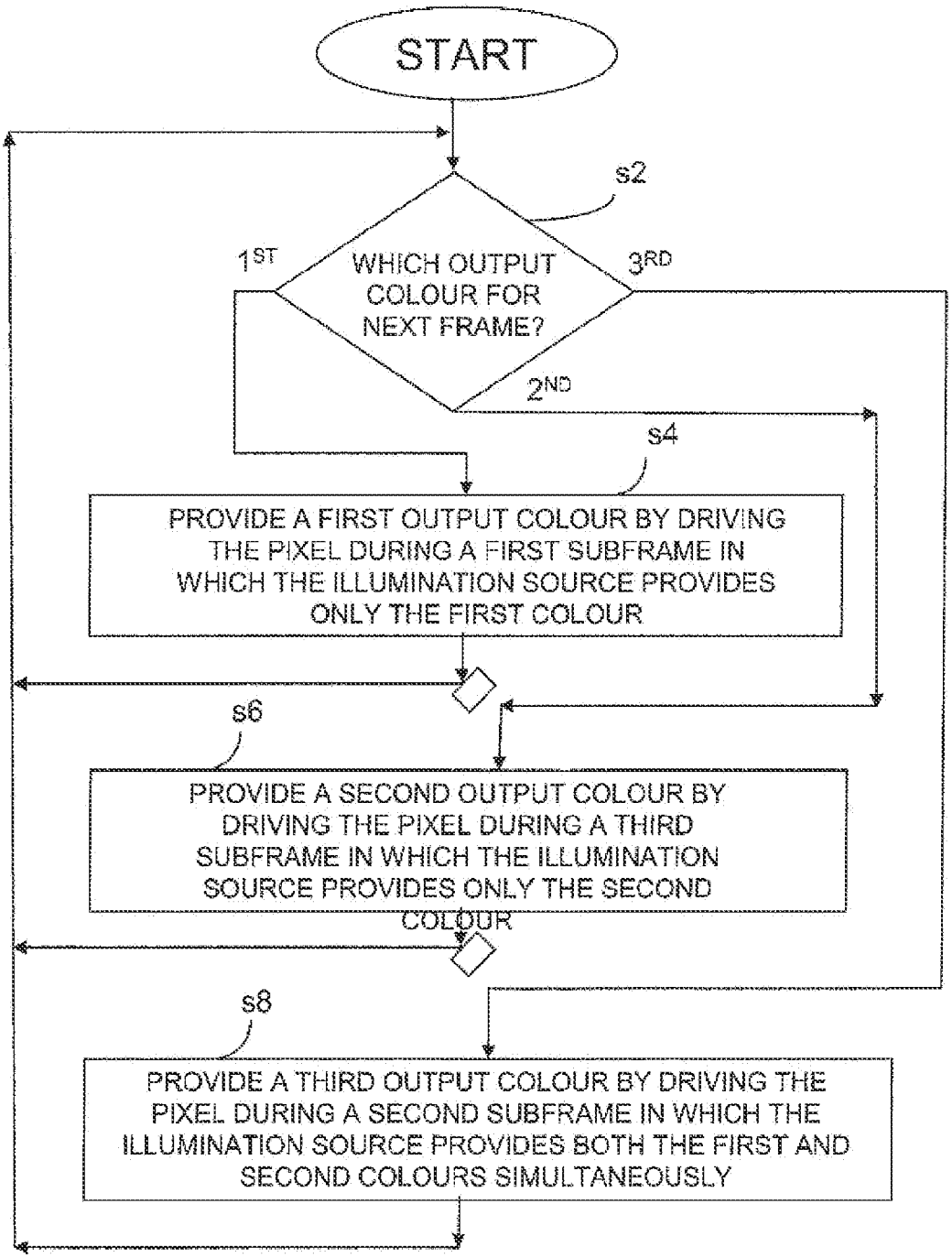
FIG. 5 is a flowchart showing certain process steps of an embodiment of a method of operating a colour sequential display device.

Thus, as described above, various embodiments of a method of operating a colour sequential display device are described. For further understanding, FIG. 5 is in the form of a flowchart and shows certain process steps of this method, in particular for the driving scheme shown in, and described above with reference to, FIG. 2 (i.e. a two illumination source colours/three display output colours embodiment). The method is described in terms of a given pixel, but the same steps are applied to other (usually all) pixels of the display.

At step s2, it is determined which output colour the pixel is to display in the next frame.

If at step s2 it is determined that the colour to be displayed is a first output colour, then the process moves to step s4. At step s4, the first colour is output i.e. displayed by the pixel by driving the pixel during a first subframe (of the frame) in which the illumination source provides only the first illumination colour.

If at step s2 it is instead determined that the colour to be displayed is the second output colour, then the process moves instead to step s6. At step s6, the second colour is output i.e. displayed by the pixel by driving the pixel during a third subframe (of the frame) in which the illumination source provides only the second illumination colour.

If at step s2 it is instead determined that the colour to be displayed is the third output colour, then the process moves instead to step s8. At step s8, the third colour is output i.e. displayed by the pixel by driving the pixel during a second subframe (of the frame) in which the illumination source provides both the first and second illumination colours simultaneously.

After whichever of steps s4, s6 and s8 is performed, the process returns to step s2, i.e. the next frame is performed (after any delay for other pixels, or e.g. rows of pixels, to be driven) in the same way as the above described frame, and so on.

In the description of the above embodiments it has been assumed that the eventual output colours as displayed by the display are exactly the same as the various individual and mixed illumination source colours provided by the illumination source. However, this need not be the case, for example the display construction as a whole may include colour filtering, refraction etc. effects that result in the output colours not being of exactly the same wavelength profile as the illumination source colours. It will be appreciated by the skilled person that in the above described embodiments the various output colours may therefore correspond to the respective illumination source individual or mixed colours, i.e. be substantially the same, but not necessarily of exact wavelength match, particularly when the illumination source colours themselves are not individually monochromatic.

The various colours and colour combinations used in the above described embodiments are not the only possible ones. For example, although in the embodiment described above with reference to FIG. 2 the two illumination source colours are green and red, with resulting output colours of green, red and yellow, nevertheless in other embodiments, other colours may be used in e.g. for example another possibility for a two illumination source colours/three display output colours embodiment is to use red and blue as the two illumination source colours.

The order within a frame in which the various illumination source colours are driven (and corresponding data provided) in the above described embodiments are not the only possible ones, and in other embodiments any other order may be used. For example, the subframes when green and red illuminations are provided in the FIG. 2 embodiment may be swapped. A further possibility is that the mixed colour does not need to be provided in the second of the three subframes, e.g. the mixed colour could instead be provided in the third subframe by having e.g. the green illumination source on for the second and third subframes only, and the red illumination source on for the first and third subframes only. Of course, similar variations, of which there are many possible permutations, are possible with embodiments with more colours, such as the embodiment described with reference to FIG. 4.

The number of display output colours described for the above embodiments are not the only possibilities. For example, the three illumination colour embodiment of FIG. 4 provides seven output colours by having dedicated subframes for each of the possible combinations of those three illumination source colours. However, in other embodiments, only some of those possible combinations may be used, e.g. in the FIG. 4 embodiment, the white subframe may be omitted and instead the display only provide six colours overall making use of six subframes per frame.

In the above described embodiments the different illumination colours provided by the illumination source are provided by use of a colour wheel a (and a multi-wavelength light source). However, this need not be the case, and in other embodiments any other appropriate form of providing different colours time sequentially may be used. For example, different colour light sources may be switched on and off or otherwise controllably shuttered.

In the above described embodiment the display panel is an active matrix liquid crystal display panel. However, this need not be the case, and in other embodiments any other suitable display panel may be used, for example a micromirror display device. Also, the display panel may be reflective or transmissive. Furthermore, the display panel may be in a compact form where the illumination source is integrated in a flat panel form with the display panel, or may be a projection display type display panel, or indeed may be any other suitable type of display panel.

The exemplary frame lengths used in the above described embodiments are not essential, and on the contrary any appropriate frame lengths may be used. Preferably, to avoid flicker, the total frame time should be less than visual system integration time.

In the above described embodiments the respective subframes of a given pixel are of equal length. However, this need not be the case, and in other embodiments one or more of the respective subframes of a given pixel may be of different length to one or more other subframes in the frame. Also, in the above described embodiments the brightness level of the illumination of a given colour provided by the illumination source is the same for each illumination source colour. However, this need not be the case, and in other embodiments, the brightness level of the illumination of one or more of the illumination source colours provided by the illumination source may be different to that of one or more of the other illumination source colours. By selection or control, either in a predetermined design sense, or in a user controllable sense, of either or both of the two variable discussed in this paragraph, the relative brightness of different display output colours may be controlled.

In FIGS. 2 and 4, and the descriptions thereof, for simplicity it is assumed the illumination sources are driven, and data is applied, for each subframe (where the relevant data or colour driving is taking place), for exactly the duration of the subframe i.e. from the start of the subframe (but not before it) to the end of the subframe (but not after it). However, this need not be the case, and in practise and/or in other embodiments, such driving may start shortly before or shortly after the start of a subframe, and/or such driving may end shortly before or shortly after the end of a subframe. In other words, it is sufficient that for a substantial part of any given subframe only the relevant colour data and colour illumination(s) are driven, even if there is not perfect cut-in and/or cut-off.

In the above embodiments various functional parts of the display device are separately provided, and arranged in connection to each other, as shown in, and described with reference to, FIG. 1. However, such division and connection is not the only possibility, for example in other embodiments the functions of both the pixel driver circuit and the illumination driver circuit may be carried out by a single driver circuit, and the functions of the display controller may be included in such a combined driver, or in the case of separate drivers may included in part in each such separate driver, and so on. Likewise, the above described functions may be implemented by modules or circuits of any appropriate form, for example by adapting conventional apparatus and/or providing additional modules or circuits. The apparatus may be in the form of hardware, firmware, or software, or a combination of these. The apparatus may comprise one or more processors, for implementing instructions and using data stored in a storage medium such as a computer disk or PROM. More generally, it will be appreciated that many arrangements of display device driving circuits and so on exist in addition to the particular example given in FIG. 1, and accordingly the skilled person will choose any appropriate arrangement according to the particular requirements under consideration.

In further embodiments, the driving circuits are arranged such that the display device can at certain times be operated in the above described modes, and at other times can be driven in conventional colour sequential display mode where e.g. a wider range of output colours are provided by performing conventional time-mixing of colours within a frame to provide a desired output colour. These latter output colours would suffer from colour breakup when moving relative to the eye. Nevertheless, there may be applications where for some of the time a reduced colour choice is acceptable but colour breakup is to be avoided, whereas at other times more colour choice is required but colour breakup is less of concern. For example, at certain times eye movement of the user may be expected and at other times eye movement may not be expected.

In further embodiments, the maximum brightness of a mixed colour is increased by driving the pixel throughout all the subframes where any of the colours providing the mixed colour are provided by the illumination source. This will then provide a compromise between increased brightness whilst reducing although not eliminating colour breakup. This approach may be applied at all times for a given device. In other embodiments this approach may be applied in a given device at certain times, but not at other times, i.e. for some frames but not all frames. This particular increased brightness driving may, for example, be implemented only in alarm situations where noticing a displayed image, especially a symbol, is particularly important. Also, this particular increased brightness driving may be performed for just one of the output colours e.g. a colour provided by simultaneous application of two illumination source colours.

The invention claimed is:

1. A color sequential display method, the method comprising, in a given frame: providing, a display panel having a plurality of pixels constructed and arranged to be illuminated via an illumination source by one of a group of subframes that includes a first subframe, a second subframe and a third subframe of the frame, each subframe occupying a separate respective temporal part of the frame and in that order, the display panel further constructed and arranged such that a given one of the plurality of pixels is driven substantially during only one of the first subframe, the second subframe and the third subframe in the given frame to display an output color; causing the illumination source to generate a first and only illumination color during the first subframe; causing the illumination source to generate a second and only illumination color during the third subframe; and causing the illumination source to generate both of the first and second illumination colors only during the second subframe, such that the output color comprises: substantially only the first illumination color when the given pixel is driven in the first subframe to provide illumination from the illumination source; substantially only the second illumination color when the given pixel is driven in the third subframe to provide illumination from the illumination source; and both the first illumination color and the second illumination color simultaneously when the given pixel is driven in the second subframe to provide a third illumination color as illumination from the illumination source, the third illumination color being an illumination color provided by mixing of the first and second illumination colors, wherein the first illumination color is green, the second illumination color is red, and the third mixed illumination color is provided by mixing the green and the red.

2. A method according to claim 1, wherein the first illumination color is green, the second illumination color is red, and the third illumination color is provided by mixing the green and the red.

3. A method according to claim 1, wherein the first illumination color of green, the second illumination color of red, and the third illumination color provided by mixing the green and the red are the only illumination colors provided by the illumination source.

4. A method according to claim 1, wherein further illumination colors are provided in further subframes of the frame.

5. A method according to claim 1, comprising:

displaying only symbols via the display panel.

6. A method according to claim 1, further comprising driving the given pixel substantially during only the second subframe when driven to display an output color corresponding to the third illumination color provided by mixing the green and the red.

7. A display driver for a color sequential display device, the display driver comprising; an illumination driver; and a pixel driver constructed and arranged to drive a given pixel substantially only during one subframe of a given frame to display an output color, wherein the illumination driver is arranged for driving an illumination source of the color sequential display device in the given frame in which a first subframe, a second subframe and a third subframe of the frame each occupy a separate respective temporal part of the frame and in that order, wherein the pixel driver is further constructed and arranged such that the given pixel is driven substantially during only one of the first subframe, the second subframe and the third subframe in the given frame, wherein the illumination driver is configured to cause the illumination source to generate a first and only illumination color during the first subframe, wherein the illumination driver is configured to cause the illumination source to generate a second and only illumination color during the third subframe, and wherein the illumination driver is configured to cause the illumination source to generate both of the first and second illumination colors only during the second subframe, such that the output color comprises; substantially only the first illumination color when the given pixel is driven in the first subframe to provide illumination from the illumination source; substantially only the second illumination color when the given pixel is driven in the third subframe from the illumination source; and both the first illumination color and the second illumination color provided simultaneously when the given pixel is driven in the second subframe to provide a third illumination color to provide illumination from the illumination source, the third illumination color being an illumination color provided by mixing of the first and second illumination colors, wherein the first illumination color is green, the second illumination color is red, and the third mixed illumination color is provided by mixing the green and the red.

8. A display driver according to claim 7, wherein the first illumination color is green, the second illumination color is red, and the third illumination color is provided by mixing the green and the red.

9. A display driver according to claim 7, wherein the first illumination color of green, the second illumination color of red, and the third illumination color provided by mixing the green and the red are the only illumination colors.

10. A display driver according to claim 7, wherein further illumination colors with further corresponding output colors are provided in further subframes of the frame.

11. A display driver according to claim 7, comprising:

a display for displaying only symbols.

12. A display driver according to claim 7, wherein the pixel driver is arranged for driving, in the given frame, the given pixel substantially during only the second subframe when driven to display an output color, corresponding to the third illumination color provided by mixing the green and the red.

13. A color sequential display device, comprising: a pixel driver constructed and arranged to drive a given one of a plurality of pixels substantially only during one subframe of a given frame to display an output color; an illumination source; an illumination driver constructed and arranged for driving the illumination source in the given frame in which a first subframe, a second subframe and a third subframe of the frame each occupy a separate respective temporal part of the frame and in that order, wherein the pixel driver is further constructed and arranged such that the given pixel is driven substantially during only one of the first subframe, the second subframe and the third subframe in the given frame, wherein the illumination driver is configured to cause the illumination source to generate a first and only illumination color during the first subframe, wherein the illumination driver is configured to cause the illumination source to generate a second and only illumination color during the third subframe, and wherein the illumination driver is configured to cause the illumination source to generate both of the first and second illumination colors only during the second subframe, such that the output color comprises: substantially only the first illumination color when the given pixel is driven in the first subframe to provide illumination from the illumination source; substantially only the second illumination color when the given pixel is driven in the third subframe to provide illumination from the illumination source; and both the first illumination color and the second illumination color simultaneously when the given pixel is driven in the second subframe to provide a third illumination color from the illumination source, the third illumination color being an illumination color provided by mixing of the first and second illumination colors; and a display panel having the plurality of pixels for displaying the output color, the display panel driven by the pixel driver, and the display panel illuminated by the illumination source, wherein the first illumination color is green, the second illumination color is red, and the third mixed illumination color is provided by mixing the green and the red.

14. A color sequential display device according to claim 13, wherein the pixel driver drives the given pixel substantially during only the second subframe when driven to display an output colour corresponding to the third illumination color provided by mixing the green and the red.

* * * * *